United States Patent [19]

Schram

[11] Patent Number: 4,496,234

[45] Date of Patent: Jan. 29, 1985

[54] RELEASE AGENT MANAGEMENT SYSTEM FOR HEAT AND PRESSURE FUSER APPARATUS

[75] Inventor: Joseph G. Schram, Liverpool, N.Y.

[73] Assignee: Xerox Corporation, Stamford, Conn.

[21] Appl. No.: 490,616

[22] Filed: May 2, 1983

[51] Int. Cl.[3] ..... G03G 15/20

[52] U.S. Cl. ..... 355/3 FU; 118/60; 219/216; 432/60; 355/14 FU

[58] Field of Search ..... 355/3 FU, 14 FU; 219/216, 388, 469; 432/60; 118/60, 652, DIG. 1 430/98, 99, 124, 126

[56] References Cited

U.S. PATENT DOCUMENTS 4,047,885 9/1977 Hauman, Jr. ..... 432/60

4,231,653 11/1980 Nagahara et al. ..... 355/3 FU

FOREIGN PATENT DOCUMENTS 1399740 7/1975 United Kingdom ..... 118/60

OTHER PUBLICATIONS

*IBM Technical Disclosure Bulletin,* vol. 24, No. 9, Feb. 1982, Machmer, J. A., "Hot Roll Fuser", pp. 4619–4620.

*Primary Examiner*—John F. Gonzales

*Assistant Examiner*—J. Pendegrass, Jr.

[57] ABSTRACT

A release agent management (RAM) system for use with a heat and pressure fuser. The system is characterized by the use of a simple reciprocating, positive displacement pump for delivering silicone oil to the heated roll of the fuser. The pump is actuated in response to the fuser rolls being engaged and disengaged, such movement being adapted to act against one or the other of a pair of springs which in cooperation with the oil being pumped forms a damper system which is utilized to control the quantity of oil delivered. The springs and oil cause the velocity of the pump's piston to decay with time which results in more oil being pumped initially.

8 Claims, 2 Drawing Figures

RELEASE AGENT MANAGEMENT SYSTEM FOR HEAT AND PRESSURE FUSER APPARATUS

Figure 1:
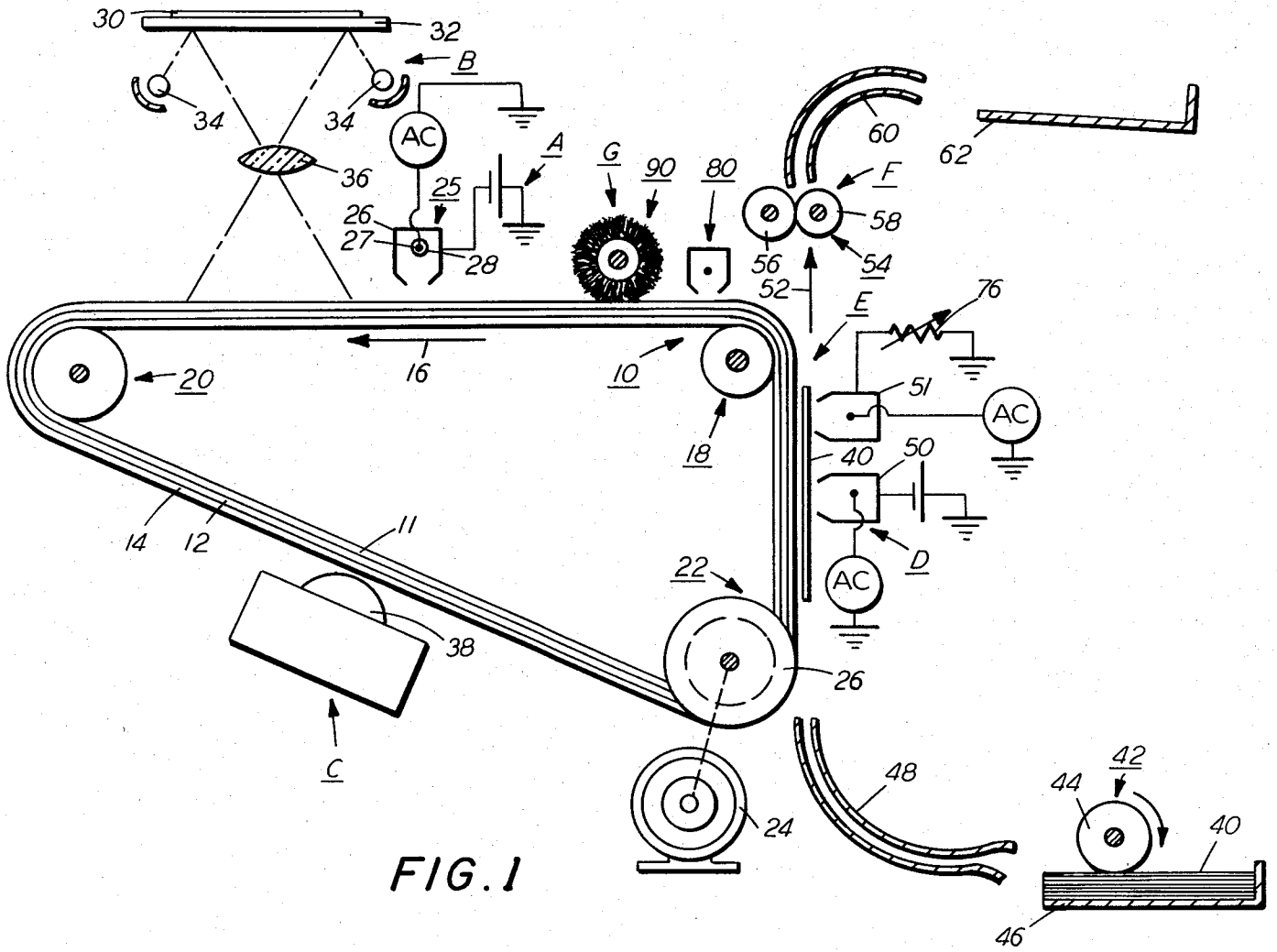

This invention relates, in general to apparatus for fixing toner images to a substrate and, in particular to a release agent management (RAM) system for a heat and pressure fuser.

The present invention is particularly useful in the field of xerography where images are electrostatically formed upon a member and developed with resinous powders known as toners, and thereafter fused or fixed onto sheets of paper or other substrates to which the powder images have been transferred. The resin-based powders or toners are generally heat and/or pressure softenable, such as those provided by toners which contain thermoplastic resins which have been used conventionally in a variety of commercially known methods. While the invention is particularly useful in the field of xerography, it is also useful in other image forming arts so long as the image is ultimately made up of toner material and is to be fused by heat and pressure.

In order to fuse images formed of the resinous powders or toners, it is necessary to heat the powder, to submit the powder to pressure or to use a combination of heat and pressure to fix or fuse the resinous powders or toners to a particular substrate. Temperature and/or pressure ranges will vary depending upon the softening range of the particular resin used in the toner. When heat is used in conjunction with pressure to fuse the images to a substrate, it is generally necessary to heat the toner powder to a temperature in excess of 180° C. or higher. Temperatures as high as 190° C. or even higher are not uncommon in commercially known methods and devices. Corresponding nip pressures are on the order of 100–200 psi.

It has long been recognized that one of the fastest and most positive methods of applying heat for fusing the powder images by direct contact of the resin-based powder with a hot surface, such as a heated roll, while pressure is being applied to the substrate to which the powder image is to be fused or fixed. But, in most instances, the powder image is tackified by the heat and/or pressure causing part of the image carried by the support material to stick to the surface of the plate or roll or any other configuration used so that as the next sheet is advanced into contact with the heated surface, the tackified image, partially removed from the first sheet, will partly transfer to the next sheet and at the same time, part of the tackified image from said next sheet would adhere to the heated surface. This process is commonly referred to in the art as "offset" a term well known in the art.

The offset of toner onto the heated surface led to the development of improved methods and apparatus for fusing toner images. These improvements comprise fusing toner images by forwarding the sheet or web of substrate material bearing the image between two rolls at least one of which is heated, the roll contacting the image being provided with a thin (i.e. 0.025–0.075 mm) coating of tetrafluorethylene resin and a silicone oil film to prevent toner offset. The outer surfaces of such rolls have also been fabricated of fluorinated ethylene-propylene or silicone elastomers coated with silicone oil as well as silicone elastomers containing low surface energy fillers such as fluorinated organic polymers and the like. A tendency of these rolls to pick up the toner when operated at elevated temperatures generally requires some type of release fluid to be continuously applied to the surface of the roll to prevent such offset. Polydimethyl-siloxane fluids commonly known as silicone oil are generally well adapted for this purpose. Not only are the polydimethyl-siloxane fluids well known for this purpose but functional polyorgano-siloxane release agents have also been described for this purpose. It is also well known to utilize fluids of low viscosity, for example, 100–200 centisokes as well as fluids of relatively high viscosity, for example, 12,000 centistokes to 60,000 centistokes and higher.

These fluids are applied to the surface of the heated roll by various devices known as Release Agent Management (RAM) Systems, the most common of which comprises a wick structure supported in physical contact with the fuser roll. It has long been recognized that the inclusion of a Release Agent Management System as a part of a fuser design represents a significant percentage of the cost fusing toner images.

One such device utilizes a pump to convey the release agent to the wick. The pump is actuated by a ratchet and pawl mechanism in response to the engagement/disengagement cycle of the fuser rolls and requires approximately 40 of the ratchet key to moved in order to move the pump piston one full stroke. Not only are such mechanisms costly, they are also complex in construction. Moreover, they do not compensate for variable run times which may be as short as the time it takes to make one copy or as long as the time required to make twenty-five copies or more. Additionally, RAM systems of the prior art do not compensate for variable standby periods (i.e. the time interval between copy runs). Generally speaking more oil is initially required for short runs because the fuser system is initially dry and thus enough oil has to be delivered to obviate this condition whereas with longer runs the fuser has enough time to become properly lubricated over the length of the run.

In view of the foregoing, it will be appreciated that a RAM system that is relatively inexpensive, simple in construction and which dispenses variable quantities of oil for varying run lengths while ensuring an adequate supply of oil for the shorter run lengths is highly desirable.

Accordingly, there is disclosed hereinbelow a RAM system that is capable of delivering variable amounts of oil depending on the length of copy run and which ensures higher oil per copy for short runs. Also, the device disclosed is simple in construction and relatively inexpensive. Thus, for the shorter copy runs, a lesser quantity of oil is delivered and for longer runs a larger quantity of oil is delivered. To these ends, there is provided a simple reciprocating, positive displacement pump mechanism provided with an oil delivery control mechanism comprising a pair of pre-compressed springs which along with the oil being pumped control the amount of oil taken into the pump during intake and also control the quantity of oil delivered. The oil and the springs act to dampen the piston movement therefore its velocity decays with time. Accordingly, a larger amount of oil is initially delivered, thus, meeting the requirement of more oil for short copy runs.

Figure 2:
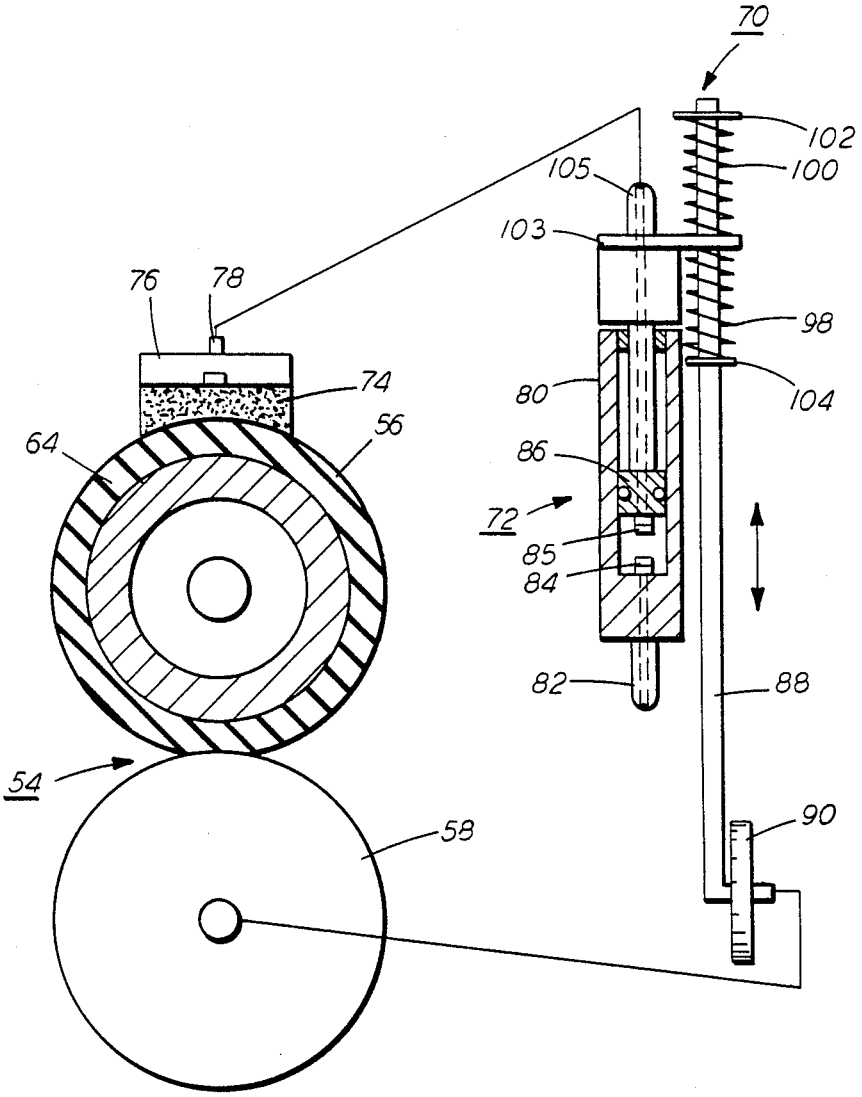

The present invention will be more fully understood when described in conjunction with the drawings wherein:

FIG. 1 is a schematic illustration of a printing machine incorporating the invention; and FIG. 2 is a schematic illustration of a release agent management system forming a part of the present invention.

Inasmuch as the art of electrophotography is well known, the various processing stations employed in the printing machine illustrated in FIG. 1 will be described only briefly.

As shown in FIG. 1, the machine utilizes a photoconductive belt 10 which consists of an electrically conductive substrate 11, a charge generator layer 12 comprising photoconductive particles randomly dispersed in an electrically insulating organic resin and a charge transport layer 14 comprising a transparent electrically inactive polycarbonate resin having dissolved therein one or more diamines. A photoreceptor of this type is disclosed in U.S. Pat. No. 4,265,990 issued May 5, 1981 in the name of Milan Stolka et al, the disclosure of which is incorporated herein by reference. Belt 10 moves in the direction of arrow 16 to advance successive portions thereof sequentially through the various processing stations disposed about the path of movement thereof. Belt 10 is entrained about stripping roller 18, tension roller 20, and drive roller 22. Drive roller 22 is mounted rotatably and in engagement with belt 10. Motor 24 rotates roller 22 to advance belt 10 in the direction of arrow 16. Roller 22 is coupled to motor 24 by suitable means such as a belt drive (not shown).

Belt 10 is maintained in tension by a pair of springs (not shown) resiliently urging tension roller 20 against belt 10 with the desired spring force. Both stripping roller 18 and tension roller 20 are rotatably mounted. These rollers are idlers which rotate freely as belt 10 moves in the direction of arrow 16.

With continued reference to FIG. 1, initially a portion of belt 10 passes through charging station A. At charging station A, a corona device, indicated generally by the reference numeral 25, changes the belt 10 to a relatively high, substantially uniform negative potential. A suitable corona generating device for negatively charging the photoconductive belt 10 comprises a conductive shield 26 and a dicorotron electrode comprising an elongated bare wire 27 and a relatively thick electrically insulating layer 28 having a thickness which precludes a net d.c. corona current when an a.c. voltage is applied to the corona wire and when the shield and the photoconductive surface are at the same potential. Stated differently, in the absence of an external field supplied by either a bias applied to the shield or a charge on the photoreceptor there is substantially no net d.c. current flow. When the shield and photoconductive surfaces are at different potentials, for example, when there is a bias voltage applied to the shield, corona emission emanate from the dicorotron electrode, the polarity thereof being that of the shield bias.

Next, the charged portion of photoconductive belt is advanced through exposure station B. At exposure station B, an original document 30 is positioned facedown upon transparent platen 32. Lamps 34 flash light rays onto original document 30. The light rays reflected from original document 30 form light images which are transmitted through lens 36. The light images are projected onto the charged portion of the photoconductive belt to selectively dissipate the charge thereon. This records an electrostatic latent image on the belt which corresponds to the informational area contained within original document 30. Alternatively, the exposure station B could contain an electrographic recording device for placing electrostatic images on the belt 10 in which case, the corona device 25 would be unnecessary.

Thereafter, belt 10 advances the electrostatic latent image to development station C. At development station C, a magnetic brush developer roller 38 advances a developer mix (i.e. toner and carrier granules) into contact with the electrostatic latent image. The latent image attracts the toner particles from the carrier granules thereby forming toner powder images on the photoconductive belt.

Belt 10 then advances the toner powder image to transfer station D. At transfer station D, a sheet of support material 40 is moved into contact with the toner powder images. The sheet of support material is advanced to transfer station D by a sheet feeding apparatus 42. Preferably, sheet feeding apparatus 42 includes a feed roll 44 contacting the upper sheet of stack 46. Feed roll 44 rotates so as to advance the uppermost sheet from stack 46 into chute 48. Chute 48 directs the advancing sheet of support material into contact with the belt 10 in timed sequence so that the toner powder image developed thereon contacts the advancing sheet of support material at transfer station D.

Transfer station D includes a corona generating device 50 which sprays negative ions onto the backside of sheet 40 so that the toner powder images which comprise positive toner particles are attracted from photoconductive belt 10 to sheet 40. For this purpose, approximately 50 microamperes of negative current flow to the copy sheet is effected by the application of a suitable corona generating voltage and proper bias.

Subsequent to transfer the image sheet moves past a detack corona generating device 51 positioned at a detack station E. At the detack station the charges placed on the backside of the copy sheet during transfer are partially neutralized. The partial neutralization of the charges on the backside of the copy sheet thereby reduces the bonding forces holding it to the belt 10 thus enabling the sheet to be stripped as the belt moves around the rather sharp bend in the belt provided by the roller 18. After detack, the sheet continues to move in the direction of arrow 52 onto a conveyor (not shown) which advances the sheet to fusing station F.

Fusing station F includes a fuser assembly, indicated generally by the reference numeral 54, which permanently affixes the transferred toner powder images to sheet 40. Preferably, fuser assembly 54 includes a heated fuser member in the form of a roller 56 adapted to be pressure engaged with a backup roller 58. Sheet 40 passes between fuser roller 56 and backup roller 58 with the toner powder images contacting fuser roller 56. In this manner, the toner powder image is permanently affixed to sheet 40. After fusing, chute 60 guides the advancing sheet 40 to catch tray 62 for removal from the printing machine by the operator.

The fuser roller may comprise an outer coating or layer 64 of an elastomeric material such as silicone rubber, Viton (a trademark of E. I. DuPont) or a polymer such as Teflon (also a trademark of E. I. DuPont). Each of these materials have been used for xerographic fusers because of their abhesive (i.e. non-adhesive) property. Even though such materials have a low affinity for toner, it has been customary to apply silicone oil thereto to thereby enhance the abhesive nature of the surface.

In accordance with the present invention, there is provided a RAM system for applying silicone oil to the fuser roll surface which system is not only inexpensive and simple in construction but is capable of dispensing variable amounts of oil in accordance with the duration of such things as copy run length. The RAM system of this invention is also adapted to ensure an adequate oil supply for short copy run.

Illustrated in accordance with the present invention, in FIG. 2, is a release agent management system or device generally indicated by reference character 70 which comprises a pump 72 for conveying silicone oil from an oil supply such as a bottle (not shown) to a wick 74 supported in contact with the top surface of the heated fuser roll 56. To dispense the silicone oil it is first delivered to an oil distribution member 76 through an inlet 78 thereof after which it is distributed by a suitable channel (not shown) disposed internally of the member 76 which channel communicates with a plurality of outlet orifices (not shown). The member 76 may be constructed in various configurations not discussed herein, the specific construction thereof not being necessary to an understanding of the present invention.

The pump 72 comprises a simple reciprocating, positive displacement pump mechanism including a fixedly mounted body portion 80 having an inlet 82 which is connected by a tube (not shown) to a suitable container such as a bottle (also not shown). A conventional pneumatic tire valve 84 controls the flow of silicone oil into the pump 72 through the inlet 82. A pump piston 86 adapted to be vertically displaced relative to the stationary body 80 creates a pressure differential across valve 84 as a result of its upward movement thereby causing oil to flow into a cavity in the pump body. Contrariwise, when the piston 86 moves downwardly, the oil in the cavity is pumped out through an outlet 105 which is operatively coupled to the channel 76.

To effect vertical movement of the piston, it is connected to a pair of actuator members 88 and 90 which are cammed upwardly when the fuser rolls 56 and 58 of heat and pressure fuser 54 are moved out of pressure engagement. The upward movement of the arm 88 immediately places a spring 98 in compression while the compression of a spring 100 is delayed depending upon its spring rate relative to the spring rate of the spring 98 and the viscosity of silicone oil. For the purposes of this disclosure, it may be assumed that the springs have identical spring rates and that their free height lengths are the same. However, as will be appreciated the spring rates may be different depending upon the application. The springs are captivated between upper and lower washers 102 and 104 carried by the member 88 and a flat follower member 103 fixedly attached to the pump piston 86. The springs together with the relatively viscous (i.e. 2,000 to 3,000 centistoke viscosity) oil being moved through the pump form a damper system for controlling the quantity of oil pumped during actuation of the pump. The springs and the oil serve to dampen the piston movement therefore its velocity decays with time. Stated differently, the piston travels at a faster velocity initially. Thus, a larger amount of oil is delivered initially which is desirable for short copy runs.

As noted hereinabove, the members 88 and 90 are actuated upon engagement and disengagement of the fuser rolls 56 and 58, being effective to cause the immediate compression of the spring 98 and the delayed compression of the spring 100. The reason for the difference in effecting spring compression is due to the fact that the piston is slow to move upwardly at this time because it has to do so against the force of the spring 100 and the frictional forces of the silicone oil acting on the piston. Thus, since the spring 100 moves freely (i.e. no forces retarding its movement) upward with the upward movement of the member 88, it is not immediately compressed. The compressed spring 98 acts, as it resumes its initial condition (i.e. its position when the rolls are disengaged), to move the piston 80 through the oil intake part of its cycle. Conversely, when the rolls become engaged, the spring 100 is immediately compressed through downward movement of the member 88. The return of the spring 100 to its non-compressed state causes the piston 80 to move through the oil delivery part of its cycle.

As may now be appreciated, there has been provided an oil delivery system for use in conjunction with fusing toner images to copy substrates wherein the quantity of oil delivered can be effectively controlled in accordance with the quantity of oil required. Thus, for the shorter copy runs a larger quantity of oil is initially delivered to ensure adequate oil delivery and for longer copy runs the system is capable of supplying a greater quantity of oil over the entire run length.

I claim:

1. Release agent management apparatus for use with a heat and pressure fuser for fixing toner images to copy substrates by passage of the substrates between two pressure engaged rolls, said apparatus comprising:

a pump including a piston;

means operatively coupling said pump to one of said two rolls whereby said pump is actuated upon the engagement and disengagement of said two rolls; and means responsive to actuation of said coupling means for causing said pump to operate at a variable velocity.

2. Apparatus according to claim 1 wherein said pump comprises a simple reciprocating, positive displacement device.

3. Apparatus according to claim 2 wherein said responsive means comprises spring means which is compressed upon engagement and disengagement of said two rolls and which is effective to move the pump piston.

4. Apparatus according to claim 3 wherein said responsive means comprises a pair of springs one of which is operable to cause said pump to take in oil and the other of which is operable to expel oil.

5. Apparatus according to claim 1 wherein said responsive means comprises spring means which is compressed upon engagement and disengagement of said two rolls and which is effective to move the pump piston.

6. Apparatus according to claim 1 wherein said responsive means comprises a pair of springs one of which is operable to cause said pump to take in oil and the other of which is operable to expel oil.

7. Apparatus according to claim 6 wherein said springs have identical spring rates and equal free height lengths.

8. Apparatus according to claim 6 wherein said springs are carried by an actuator member and are disposed to opposite sides of follower member carried by the piston of said pump, said springs being individually compressible each spring's compression depending upon the direction of movement of said actuator member.

* * * * *